US009135889B2

(12) United States Patent
Marcu et al.

(10) Patent No.: US 9,135,889 B2
(45) Date of Patent: Sep. 15, 2015

(54) COLOR CORRECTION OF ELECTRONIC DISPLAYS

(75) Inventors: Gabriel G. Marcu, San Jose, CA (US); Benjamin John Becher, San Jose, CA (US); Wei Chen, Palo Alto, CA (US); Steve Swen, Cupertino, CA (US); Jesse Michael Devine, Oakland, CA (US)

(73) Assignee: Apple Inc., Cupertino, CA (US)

( * ) Notice: Subject to any disclaimer, the term of this patent is extended or adjusted under 35 U.S.C. 154(b) by 1003 days.

(21) Appl. No.: 12/251,186

(22) Filed: Oct. 14, 2008

(65) Prior Publication Data

US 2010/0091039 A1 Apr. 15, 2010

(51) Int. Cl.
*G09G 5/06* (2006.01)

(52) U.S. Cl.
CPC ..... *G09G 5/06* (2013.01); *G09G 2320/041* (2013.01); *G09G 2320/0666* (2013.01)

(58) Field of Classification Search
CPC ..... G09G 2320/041; G09G 5/06; G09G 2320/0666
USPC ..... 345/690, 101
See application file for complete search history.

(56) References Cited

U.S. PATENT DOCUMENTS

| | | | | |
|---|---|---|---|---|
| 5,231,504 | A * | 7/1993 | Magee | 358/500 |
| 5,646,750 | A * | 7/1997 | Collier | 358/518 |
| 5,936,604 | A * | 8/1999 | Endou | 345/101 |
| 6,535,208 | B1 | 3/2003 | Saltchev et al. | |
| 6,624,816 | B1 | 9/2003 | Jones, Jr. | |
| 7,119,808 | B2 | 10/2006 | Gonzalez et al. | |
| 7,221,332 | B2 | 5/2007 | Miller et al. | |
| 7,382,333 | B2 | 6/2008 | Chen et al. | |
| 7,587,120 | B2 | 9/2009 | Koo et al. | |
| 7,619,585 | B2 | 11/2009 | Bell et al. | |
| 7,619,604 | B2 | 11/2009 | Karman et al. | |
| 7,710,369 | B2 * | 5/2010 | Dowling | 345/83 |
| 7,839,368 | B2 * | 11/2010 | Chen et al. | 345/87 |
| 7,916,160 | B2 * | 3/2011 | Hsu et al. | 345/690 |
| 2003/0020725 | A1 * | 1/2003 | Matsuda | 345/600 |
| 2003/0184566 | A1 * | 10/2003 | Cheng | 345/660 |
| 2004/0036671 | A1 * | 2/2004 | Hudson | 345/101 |
| 2004/0070562 | A1 * | 4/2004 | Hudson et al. | 345/101 |
| 2004/0178743 | A1 * | 9/2004 | Miller et al. | 315/169.3 |

(Continued)

FOREIGN PATENT DOCUMENTS

| | | |
|---|---|---|
| EP | 0272655 | 6/1988 |
| EP | 1158484 | 11/2001 |

(Continued)

OTHER PUBLICATIONS

Author Unknown, "Visual Impact/Usability Benefits," PureDepth, http://www.puredepth.com/technologyPlatform_visualImpactAndUsabilityBenefits, 2 pages, at least as early as Jan. 20, 2010.

(Continued)

*Primary Examiner* — Sahlu Okebato
(74) *Attorney, Agent, or Firm* — Blank Rome LLP

(57) ABSTRACT

A method for adjusting the characteristics of a display. The method for adjusting the characteristics of the display may include constructing color models as a function of a parameter such as temperature. Furthermore, the color model may be used to determine adjustment values to be applied to a display. The adjustment values may be organized in a table as a function of temperature and color values. The adjustment values may be determined from measurements.

6 Claims, 7 Drawing Sheets

(56) References Cited

U.S. PATENT DOCUMENTS

| | | | | |
|---|---|---|---|---|
| 2005/0099431 | A1 | 5/2005 | Herbert et al. | |
| 2005/0204946 | A1* | 9/2005 | Hamashima et al. | 101/484 |
| 2006/0066265 | A1* | 3/2006 | Plotz et al. | 315/291 |
| 2006/0191177 | A1 | 8/2006 | Engel | |
| 2006/0285136 | A1* | 12/2006 | Shin et al. | 358/1.9 |
| 2007/0052735 | A1* | 3/2007 | Chou | 345/690 |
| 2008/0030509 | A1 | 2/2008 | Conroy et al. | |
| 2008/0231548 | A1 | 9/2008 | Koyama | |
| 2008/0231624 | A1* | 9/2008 | Poon | 345/212 |
| 2008/0238339 | A1* | 10/2008 | Deurenberg et al. | 315/294 |
| 2008/0252653 | A1* | 10/2008 | Alessi et al. | 345/589 |
| 2009/0244413 | A1 | 10/2009 | Ishikawa et al. | |
| 2010/0026720 | A1* | 2/2010 | Hotta et al. | 345/652 |
| 2010/0091048 | A1 | 4/2010 | Aitken et al. | |
| 2010/0103147 | A1 | 4/2010 | Sumpter | |

FOREIGN PATENT DOCUMENTS

| | | | |
|---|---|---|---|
| EP | 1962265 | | 8/2008 |
| EP | 1390938 | | 12/2008 |
| JP | 06006733 | | 1/1994 |
| TW | 200715264 | A | 4/2007 |
| TW | I282076 | | 6/2007 |
| TW | I283852 | | 7/2007 |
| WO | WO0109664 | | 2/2001 |
| WO | WO0115128 | | 3/2001 |
| WO | WO2005059880 | | 6/2005 |
| WO | WO2006112740 | | 10/2006 |

OTHER PUBLICATIONS

Bertolucci, Jeff, "Offbeat Tech: The Misfits of CES," http://www.pcworld.com/article/186406/samsung_transparent_14inch_oled_laptop.html, 2 pages, Jan. 8, 2010.

International Search Report and Written Opinion, PCT Application No. PCT/US2009/058706, 19 pages, Dec. 10, 2009.

* cited by examiner

COLOR CORRECTION OF ELECTRONIC DISPLAYS

BACKGROUND

1. Technical Field

The present invention generally relates to display correction and, more specifically, to correcting the displayed color by reducing its dependency on various variables, such as temperature.

2. Background Discussion

Many computing devices use an electronic display to present information to a user. Such displays may be, for example, liquid crystal displays ("LCDs"), cathode ray tubes ("CRTs"), organic light emitting diode displays ("OLED displays") and so on. Most such displays can show color images. However, the color response of a display may change as the display operates.

In particular, the display's white point may shift along a blackbody curve as the physical temperature of the display reaches a steady operating temperature. For example, when a display is turned on, the display may be cold and the temperature of the display may increase as the display warms up over time. The changing temperature of the display may cause the display colors to shift. For example, some displays depict white as somewhat yellowish when initially powered on and cold. As the display warms, the white point of the display shifts toward a more neutral white, such as defined by the standard illuminant, D65. The same is true for any colors shown on the display; they too shift within a color space as the temperature of the display increases. This is true even if, for example, the display only outputs grayscale colors (e.g., is a black and white display). Similarly, other parameters of the display may shift as a function of temperature such as luminance, black level, contrast, or electro-optical transfer function, which may be referred to as the "native gamma" of the display. This set of parameters may be referred to as the color profile of the display.

The shift in the color profile due to temperature increase of the display generally causes each pixel of the display to change color until a stable operating temperature is achieved, at which point the pixel colors are likewise stable. That is, although a pixel may be instructed to display the same color at an initial temperature and a stable operating temperature, the actual color displayed, as objectively measured by its chrominance and luminance, may vary. It should be noted that, in many electronic systems, individual pixels of a display receive a red, greed and blue value that together define the color to be created by the pixel. These red, green and blue values are referred to herein in the aggregate as an "RGB value," as understood to those of ordinary skill in the art.

Thus, a method of adjusting the display colors over a range of display temperatures is desirable. Accordingly, there is a need in the art for an improved method of providing consistent display colors over a range of parameters including temperature.

SUMMARY

One embodiment of the present invention takes the form of a method for correcting display characteristics. A first parameter of a first parameter set and a first display value of a set of display values may be provided. The first display value may be an RGB value. Additionally, the first parameter set may be a number of parameters of the display such as, but not limited to, temperature, luminance, black level, contrast, electro-optical transfer function and so on. An adjustment value may be determined that may correspond to the first parameter of the parameter set. A final value may be determined by applying the adjustment value to the first value of the set of display values the final may be employed to change the display. The adjustment value may be determined by locating the first parameter in a first table and corresponding to the first parameter of the first set. A new adjustment value may also be determined by interpolating the new adjustment value from the values in the first table. The new adjustment value and the corresponding input parameter may be stored in the first table. The adjustment value may also be determined by employing surrounding adjustment values to determine a slope and the slope may be employed to interpolate the new adjustment value. The first table may be constructed using a color gamut where the color gamut may be constructing by using a look-up table based model, a matrix model or other appropriate models.

In one embodiment, a second parameter of a second parameter set may be provided and the adjustment value may be determined, where the adjustment value may correspond to the first parameter of the first parameter set and the second parameter of the second parameter set. A new adjustment may also be determined by interpolation based on a combination of parameters provided by the first parameter set and the second parameter set.

In yet another embodiment, the present invention may take the form of a method for correcting display characteristics. A first parameter set comprising individual values and a first set of predetermined color values corresponding to the individual values of the parameter set may be provided. The first parameter set may be parameters such as, but not limited to, temperature, luminance, black level, contrast, electro-optical transfer function and so on. Additionally, a first set and a second set of measurements which may correspond to the individual values in the first set of predetermined values may be provided. A color gamut may be constructed and may include the first set of predetermined color values, the first set and second set of measurements and the first parameter set. A first set of adjustment values may be computed based on the color gamut and a table may be constructed which may include the first set of adjustment values and the corresponding individual values of the parameter set. A new adjustment value may be determined from the first set of adjustment values. The new adjustment value be determined by interpolating the adjustment values in the first set of adjustment values.

In yet another embodiment, a second parameter set may be provided and a second color gamut may be constructed and may include the first set and second set of measurements and the first and second parameter sets. A second set of adjustment values may be computed based on the second color gamut. A new adjustment value may be interpolated from the adjustment values in the second set of adjustment values. Additionally, the new adjustment value may be interpolated for any combination of values from the first and second parameter set. The new adjustment value and the corresponding individual value of the first parameter set may be stored in the table.

DETAILED DESCRIPTION OF EMBODIMENTS

Figure 1:
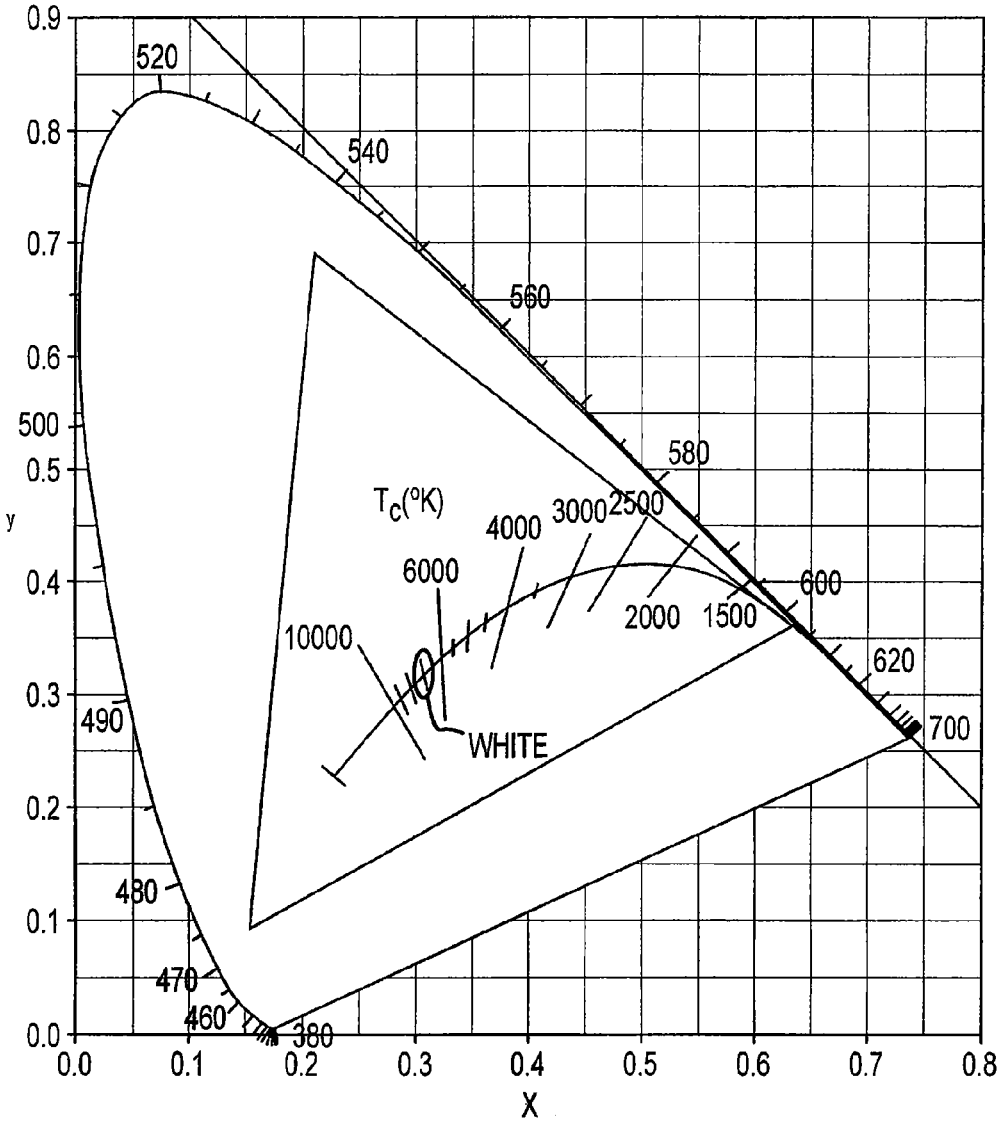
FIG. 1 is an International Commission on Illumination ("CIE") 1931 chromaticity diagram including a general black body curve illustrating the dependence of color on temperature for a black body.

Generally, one embodiment of the present invention may take the form of a method for adjusting the color of a display to account for the color shifts due to operating temperature changes. In this embodiment, a display temperature may be used as an input to determine an adjustment value. The adjustment value may be found in a look-up table or may be computed by interpolating from the values found in the table. Continuing the description of this embodiment, the adjustment value may be applied, depending on the type of display, to an RGB value that may be supplied to each pixel or to the gain of the red channel, green channel and blue channel to adjust the color of the display.

Another embodiment may take the form of a method for correcting display colors as a display warms up and changes temperature. In this embodiment, data such as luminance and chrominance values may be recorded for different RGB input values to the display, for every temperature in a set of temperatures. The recorded data may be stored in memory or as a data file. The display may produce a color range that may be referred to herein as the "display color gamut." The display color gamut may then be constructed based on the recorded data using either a matrix multiplication and gamma correction based model (called the matrix model) or a look-up table and optional interpolation based model, called the "LUT model." Generally, a color model is a way of representing the correspondence between colors as measured by an instrument on the display and the RGB numbers that produces these colors on the display. The table based model may be created, for example, by empirically measuring luminance and chrominance for a variety of pixel colors expressed in RGB values and comparing them to desired or perceived luminance and chrominance values.

These desired values generally correspond to the luminance and chrominance that are set as the luminance and chrominance target values for that display. The target may correspond to the luminance and chrominance of the displayed color when the electronic display has achieved its stable operating temperature. Alternatively, the target may correspond to a different set of luminance and chrominance values. For example, the target may be those recommended by a certain standard or selected by the user according to particular needs. As another example, a fixed luminance and D65 reference white point may be used as a target. Also, the target may be specified by a luminance and white point value that varies according to a precise function selected by the user. In short the target as luminance and white point can be an arbitrary set. At various temperature values, certain color models may be more suitable than others for coding the colors produced by that device. There may be multiple color models such that each individual color model corresponds to a specific temperature. Thus, as the temperature of the display increases, the color model of the display (or its component pixels) may change.

A target state of the display may be defined as a white point value and a luminance value of the display. For a specific temperature for which the parameters of the color model have been measured, the adjustment values for each R, G and B components may be computed using the color models and the target luminance and white point value. The RGB adjustment values may be organized into an table such that each line in the table provides the RGB adjustment values corresponding to specific temperature. For an arbitrary temperature value that is not included in the table, the corresponding RGB adjustment values may be computed by interpolating the RGB adjustment values in the table. As used herein, this table will be called RGB table.

It should be noted that embodiments of the present invention may be used in a variety of optical systems and image processing systems. The embodiment may include or work with a variety of display components, monitors, screens, images, sensors and electrical devices. Aspects of the present invention may be used with practically any apparatus related to optical and electrical devices, display systems, presentation systems or any apparatus that may contain any type of display system. Accordingly, embodiments of the present invention may be employed in computing systems and devices used in visual presentations and peripherals and so on.

Before explaining the disclosed embodiments in detail, it should be understood that the invention is not limited in its application to the details of the particular arrangements shown, because the invention is capable of other embodiments. Also, the terminology used herein is for the purpose of description and not of limitation.

FIG. 1 is a CIE 1931 chromaticity diagram which organizes all colors visible to the human visual system as a function of chromaticity coordinates. Generally, chromaticity is a quality of a color as determined by a dominant wavelength and does not account for luminance. As illustrated in FIG. 1, the wavelength of any given color of light may be represented on the chromaticity diagram as a function of chromaticity coordinates. For example, the color red corresponds to wavelengths around 630-670 nanometers, which are shown in FIG. 1 around the chromaticity coordinates (0.72, 0.27). Likewise, the color green corresponds to wavelengths having a frequency around 500-530 nanometers and appears in the black body diagram approximately at the chromaticity coordinates (0.1, 0.74). Further, the color blue corresponds to wavelengths having a frequency around 460-480. One particular sample of the color blue corresponds to the chromaticity coordinates (0.1, 0.1) in the diagram of FIG. 1.

Also as depicted in FIG. 1, the colors may vary around the perimeter of the chromaticity diagram as well as across the chromaticity diagram. For example, wavelengths of light having frequencies ranging from 640 nanometers to 520 nanometers may gradually vary in color from red, to orange, to yellow and then to green. The colors may appear as combinations of colors, such as reddish-blue (e.g., magenta) and yellow-green. Furthermore, the colors may vary two-dimensionally across the chromaticity diagram. For example, the x-axis values for visible light may vary from approximately 0.4 to 0.65 at a y-value of approximately 0.35, corresponding to colors ranging from blue-green to orangish at the two extremes. Generally, the perimeter of the chromaticity diagram corresponds to the limits of visible light that may be perceived by humans.

The chromaticity diagram of FIG. 1 includes a triangle that illustrates the range of colors that may be represented by an exemplary red, green, blue ("RGB") color space for a specific piece of hardware such as a display. Additionally, the chromaticity diagram includes a black body curve which illustrates a chromaticity locus of the black body heated to a range of temperatures. Generally, a black body is known to one of ordinary skill in the art and may emit the same wavelength and intensity as absorbed by the black body in an environment in equilibrium at temperature T. The radiation in this environment may have a spectrum that depends only on temperature, thus the temperature of the black body in the environment may be directly related to the wavelengths of the light that it emits. For example, as depicted in FIG. 1, around 1500 Kelvin, the color of the black body may be orangish-red. As the temperature increases and follows the black body curve illustrated in FIG. 1, the color of the black body may change. Thus, around 3000 Kelvin, the color of the black body may be orange-yellow, around 5000 Kelvin the color may be yellow-green and around 6700 Kelvin the color may be white.

Generally, a display may produce a color depending on the RGB input signal. Ideally, when the RGB input signal is fixed, the displayed color should also be fixed. However due to the variation of the temperature of the display from cold to warmed up, some internal parameters of the display may change, affecting the luminance and the chromaticity of the displayed color, even if the RGB input signal was not changes. This may occur because the displayed color may vary with the temperature.

A display includes multiple pixels arranged in a matrix of rows and columns. Each pixel may generate a color corresponding to an RGB value communicated to the pixel, typically by an application or operating system executed by an associated computing device. For example, each pixel may include multiple subpixels; a single subpixel may correspond to one of a red, green and blue channel. The operation of pixels and constituent subpixels to create color is known to those of ordinary skill in the art.

Figure 2:
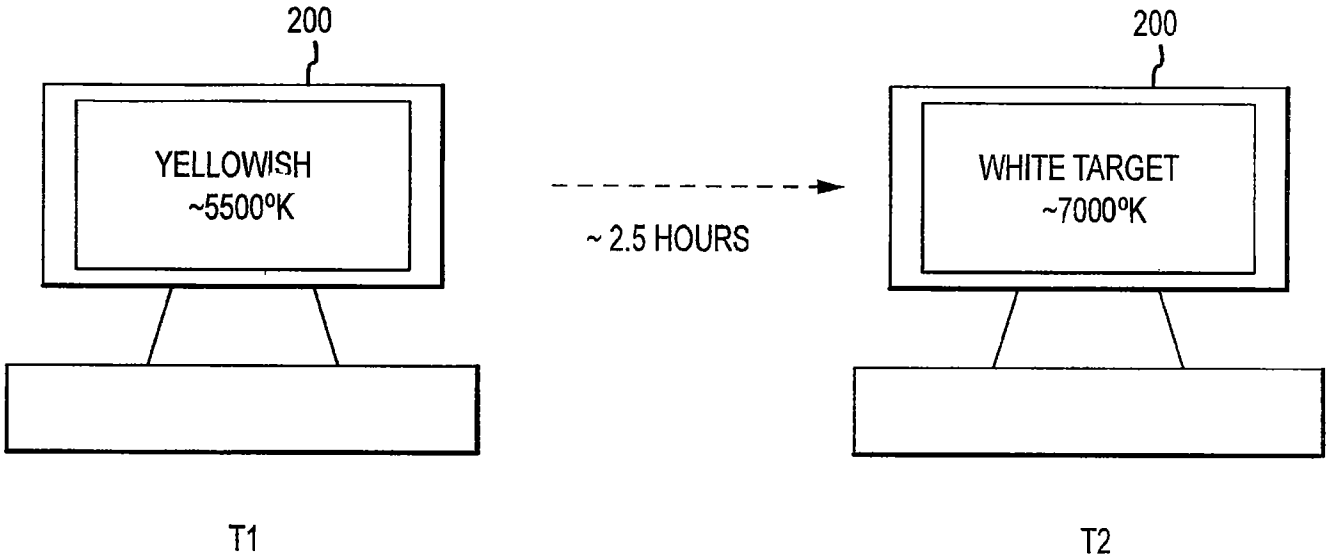
FIG. 2 is an example of an electronic display depicting a color response at a first time T1 and a second time T2, generally illustrating a dependence of the display color on warming up temperature.

In one example and as depicted in FIG. 2, a display 200 may have an initial white point corresponding to a correlated color temperature of approximately 5500 Kelvin, which may correspond to an initial power-on state at time t1. The initial white point of the display 200 may also correspond to the display at a physical temperature C1, which in one example, may be 25 degrees Celsius. At time t1, the color white as represented in the chromaticity diagram of FIG. 1, may appear on the display 200 as a yellowish color. As time passes and time t2 is reached, the physical display temperature may increase to a stable value, for example 60 degrees Celsius. The increase in physical display temperature may correspond to a change in the white point, where the white point may correspond to a correlated color temperature of approximately 7000 Kelvin. In certain embodiments, the elapsed time between times t1 and t2 may be approximately two and a half hours. At time t2, the color white, as represented in the chromaticity diagram of FIG. 1, may appear accurately rendered. Stated differently, at time t1, the display 200 may show a yellowish-white color when the target or desired color is actually neutral white. Generally, neutral white may be a white without a perceivable color shift toward any of the red, yellow, green, blue or combinations of these colors. The difference between the desired white and the actual yellowish-white color may be a function of the physical display temperature. Accordingly, at the initial display temperature a pixel receiving RGB values corresponding to "white" may instead project a yellowish color. At the stable operating temperature achieved at time t2, the pixels of the display 200 may, more accurately render the color white as defined in the chromaticity diagram of FIG. 1. It should be noted that the RGB values received by the sample pixel do not change between t1 and t2, even though the actual, objective color shifts. However, in the present invention, these RGB values are attenuated by the RGB adjustment factors as a function of temperature such that the displayed color shall remain stable independent and independent on the variation of the physical display temperature. As used herein, the term "target color" may refer to a color as shown by a display operating at a stable temperature.

Figure 3:
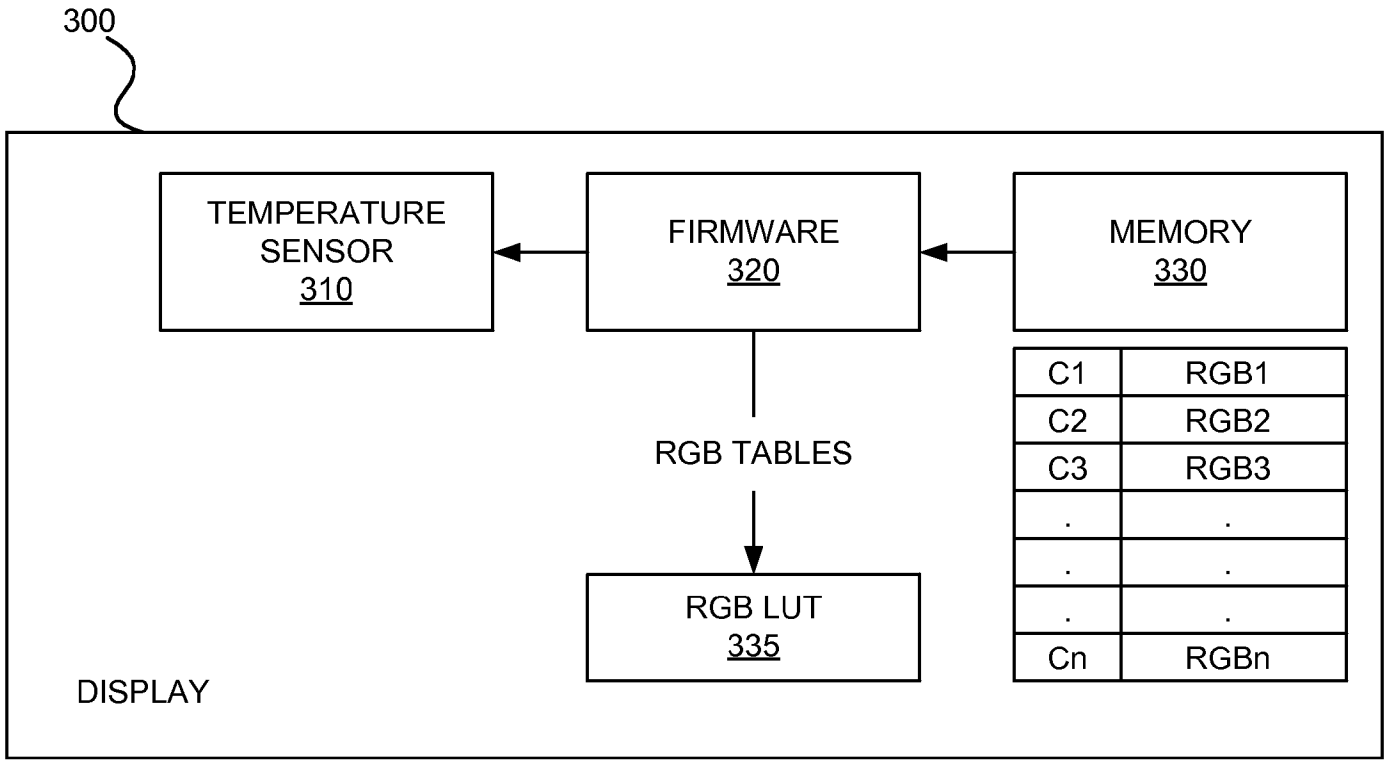
FIG. 3 depicts exemplary firmware, in accordance with a first embodiment, that may be used in an example display to compensate a color profile for the display's operating temperature.

FIG. 3 depicts one embodiment of a display 300 including firmware that may permit adjustment of displayed colors, in order to compensate for temperature. Typically, the display 300 begins operation at an initial temperature when turned on. As time passes, the display 300 increases in temperature until it reaches a stable operating temperature. As the display 300 changes temperature, the displayed colors may also change even though the RGB values may remain the same. As mentioned previously, the target colors may be the displayed colors at the stable operating temperature of the display.

Continuing the discussion of this embodiment, the display 300 may include a temperature sensor 310. The temperature sensor 310 may measure a display temperature and provide it to the firmware 320. Generally, the firmware 320 may be embedded in the display 300 and executed by a device such as a microcontroller or a microprocessor (not shown). The firmware 320 may request an adjustment value from an RGB table 335 for the temperature provided by the temperature sensor 310. The firmware 320 may then receive the adjustment value from the RGB table 335. The adjustment value may be based at least on the display temperature provided by the temperature sensor 310 and may be used to adjust the color on the display 300. The RGB table 335 may be stored in a memory which may be a memory such as an electrically erasable programmable read-only memory.

The firmware 320 may apply the adjustment value to either the input RGB values or to the gain control of the RGB channels. The adjustment value may change the display colors such that the display colors may appear as the target color. The adjustment values of the RGB table 335 may be applied to the input RGB values to the display and/or the gain of the RGB channels of a display. By applying the adjustment values to the input RGB values, the RGB values transmitted to the display may be changed. However, applying the adjustment values to the gain of the RGB channels may change the displayed color without altering the RGB values transmitted to the display. Accordingly, by applying the adjustment values to either the input RGB or to the gain of each RGB channels, the displayed colors may approximate the desired output and thus remain relatively constant as the display warms up and changes temperature. The adjustment values may be attenuation factors. The adjustment values and the RGB table 335 will be discussed in further detail below. Adjusting the displayed color by applying the adjustment value from the RGB table 335 will also be discussed in further detail below.

In one example, at a certain display temperature, a displayed color corresponding to an input RGB value may not correspond to the target color. In this example, an adjustment value corresponding to the display temperature may be determined from the RGB table 335. The adjustment value may be three values, an adjustment value for the red channel, an adjustment value for the green channel and an adjustment value for the blue channel. For explanatory purposes, although the adjustment value may be three values, it may be referred to herein as "the adjustment values." Additionally, the terms "RGB channel gain" and "input RGB values" may be referred to herein as "RGB values". Still continuing this example, the adjustment value may be applied to the RGB values so that the displayed color appears as the target color even though the display may be at a temperature different from the stable operating temperature.

Each set of adjustment values may be stored in the RGB table 335. Typically, each such set of adjustment values corresponds to a single temperature and is indexed in the RGB table 335 by the corresponding temperature. By constructing the RGB 335 table in this manner, the firmware may relatively easily retrieve the set of adjustment values necessary to modify the input RGB values for a given pixel in order to produce the desired output, so long as the current operating temperature of the display 300 is known by the firmware.

In FIG. 3, the RGB table 335 may include adjustment values that may correspond to specific temperatures and the adjustment values may be computed using color models. In one embodiment, the RGB table may appear as:

| | |
|---|---|
| T1 | RGB1 |
| T2 | RGB2 |
| \| | \| |
| Tm | RGBm |

where RGB1 through RGBm are the RGB values that may produce a white corresponding to the target white at the temperature T1 through Tm respectively, when applied to the RGB value of the display. The RGB1 through RGBm values may be used to compute the adjustment values R1 through Rm for the red component, G1 through Gm for the green component and B1 through Bm for the blue component for the temperature T1 through Tm respectively.

The adjustment values may be determined for each RGB channel at a specific temperature. The adjustment value for an arbitrary temperature T, may be computed by using the ratio:

$$Rx=Rt/Rw$$

$$Gx=Gt/Gw$$

$$Bx=Bt/Bw$$

where Rx, Gx, Bx may be the RGB values interpolated from two RGB sets from the RGB table corresponding to the temperatures T1, T2 that defines the smallest temperature interval containing the temperature T. Additionally, Rw, Gw, Bw may be the RGB values corresponding to the color white at the stable operating display temperature. Rx, Gx, Bx may be the adjustment value for each RGB channel at the arbitrary temperature, T. Once the adjustment values are determined, they may be used in firmware and/or software.

Figure 4A:
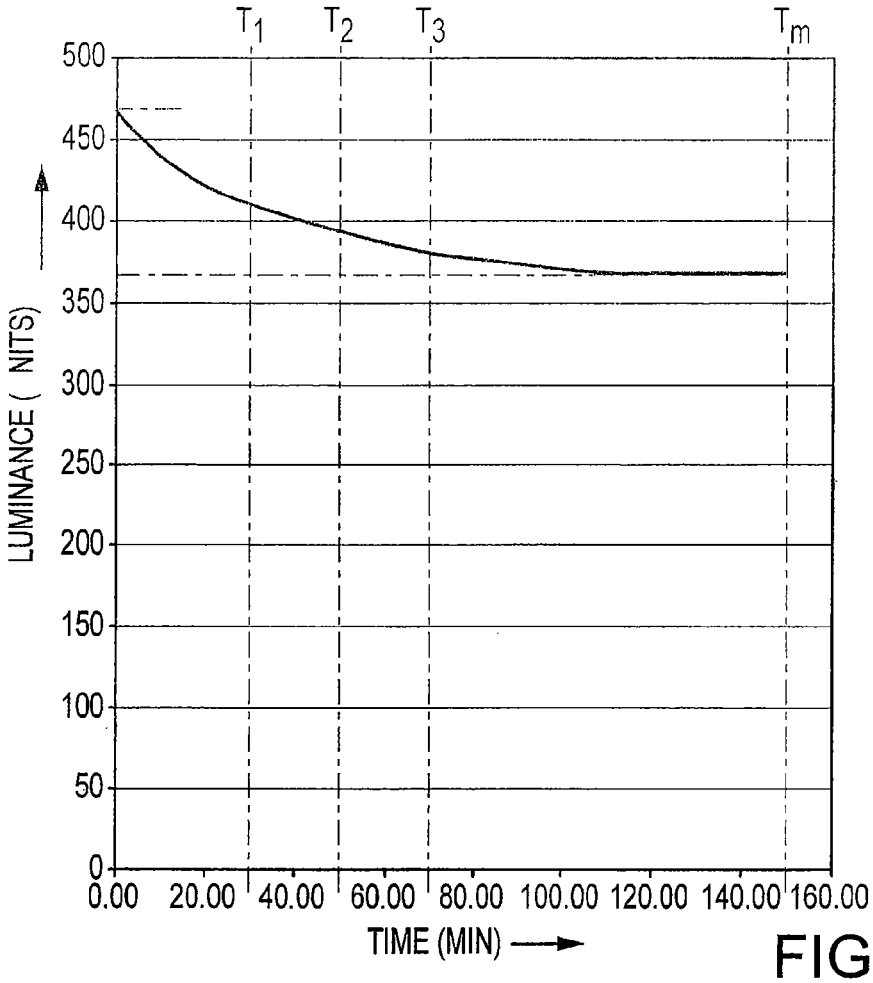
FIG. 4A depicts a graph of the variation of a sample luminance as a function of time.
Figure 4B:
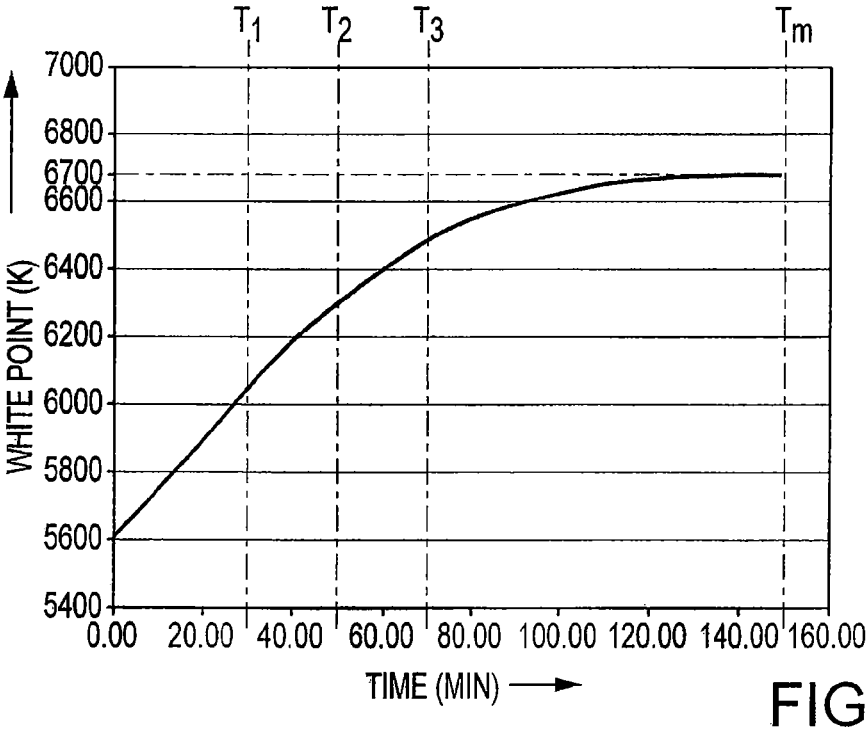
FIG. 4B depicts a graph of the variation of a sample white point, represented as Correlated Color Temperature ("CCT") as a function of time.

By applying adjustment values to the RGB values for a display, the luminance and chrominance values are effectively stabilized for the temperature range of the display. By applying the adjustment values, the measured luminance and chrominance values may be equivalent to the target luminance and chrominance values. The target luminance and chrominance values may be the luminance and chrominance values after the display has warmed up and reached a stable temperature. Before applying the adjustment values to the RGB values in the display, the output luminance and chrominance values may shift with temperature as shown in FIGS. 4A and 4B. However, after applying the adjustment values to the RGB values, the display may effectively achieve steady, end-state luminance and chrominance values substantially from the moment it is powered on. Stated differently, by applying the adjustment values, the luminance and chrominance values at an initial temperature may be very close to the luminance and chrominance values at the display's stable operating temperature. Effectively, the warm-up time of the display is reduced from time Tm (as shown in FIGS. 4A and 4B) to zero.

Additionally, adjustment values may also be determined for any value of input parameter and/or combination of input parameters, including those not originally recorded, by employing an interpolation method. The input parameters and adjustment values may be organized into an RGB table as shown above. The adjustment values may compensate for the shifting luminance and white point values over the change in display temperature as the display warms up. The adjustment values may be used to adjust the color of a display to appear as it would after the display has sufficiently warmed up to a stable temperature. The method of constructing the color model may not change the resulting RGB table, however the table size may vary corresponding to combinations of the input parameters. (As discussed herein, the color model may be constructed in a number of ways including, but not limited to, using the look-up table based model or the matrix model.) The implementation of the RGB table in firmware was previously discussed with respect to FIG. 3.

The RGB table discussed above may be derived from sets of color gamuts. A color gamut may be constructed in a number of ways. The color gamut may represent the range of possible colors that a monitor may display for a given temperature.

In one embodiment, the color gamut may be constructed by employing a look-up table based model and the color gamut may be an empirical model. In this embodiment a set of RGB values may be predetermined. The selection of the set of predetermined RGB values may be based on the number of desired values for each color. For example, six values between 0 and 255 may be chosen for the red component, six values between 0 and 255 may be chosen for the green component and six values between 0 and 255 may be chosen for the blue component. For every combination of the six values for each of the three components, a luminance (Y) and a chrominance (x, y) may be measured. These measurements may be repeated for a number of different temperatures.

As shown in FIG. 4A, for constructing a color gamut at a temperature T1, measurements corresponding to a color model and at the temperature T1 may be taken. The measurements at each of the temperatures T1 through Tm, may show the variation of luminance as in FIG. 4A or the variation of the white point in the form of the correlated color temperature value (in Kelvin) as illustrated in FIG. 4B.

Returning to constructing a color gamut, a predetermined set of RGB values may be defined. In this example, at each operating temperature T1 through Tm, the luminance (Y) and the chrominance (x, y) may be measured for each of the RGB values in the predetermined set of RGB values. If the matrix color model is used, four color measurements for pure red, pure green, pure blue and pure white, at each temperature T1, through Tm, may be used for the display. For example, pure red may be 255, 0, 0, pure green may be 0, 255, 0, pure blue may be 0, 0, 255 and pure white may be 255, 255, 255.

If a look-up table model is used with 216 samples (6×6×6=216), the measurements may be taken of luminance (Y) and chrominance (x, y) for 216 predetermined RGB values. The 216 RGB values may result from selecting six values for each of the individual RGB values and providing all possible combinations of the six values for each RGB value. The 216

RGB values is provided for explanatory purposes only. For example, at a temperature T1, a luminance and chrominance measurement may be taken for each of the 216 predetermined RGB values. Similarly, for a temperature T2, another luminance and chrominance measurement may be taken for each of the 216 predetermined RGB values and so on. Additionally, the number of samples per each component may be increased (for example, using seven or more values for each of the individual RGB values), thus increasing the accuracy of the empirical model.

Each color gamut CG1 through Cgm may be defined at each temperature T1 through Tm respectively, thus the RGB table may be calculated once the target luminance and white point values are set. The calculation of the RGB table may be performed line by line. Each line in the table may correspond to a temperature T1 through Tm, thus RGB table may have m lines. For each line, k, in the RGB table, the RGB values may be computed as follows. For temperature Tk, the target luminance and white point values may correspond to a unique color in the color gamut Cgk. The unique color may be produced by a certain RGB value, RGBk. Resolving the RGBk color for a given target color and color gamut may depend on the color model that is used for the display. For example, if the matrix model is used, the following equations are used to compute RGB from Yxy of the target:

$$X = x \cdot Y / y,\ Z = (1 - x - y) \cdot Y / y$$

$$[r_{linear}\ g_{linear}\ b_{linear}]^t = M^{-1} \cdot [XYZ]^t$$

$$R = rTRC - 1[rlinear]$$

$$G = gTRC - 1[glinear]$$

$$B = bTRC - 1[blinear]$$

where $$M = \begin{pmatrix} Xr & Xg & Xb \\ Yr & Yg & Yb \\ Zr & Zg & Zb \end{pmatrix}$$

If the look-up table model is used, the calculation of the RGB with a defined color gamut as a table of (RGB Yxy) sets, may be based on tetrahedral decomposition and tetrahedral interpolation, which are known to one of ordinary skill in the art.

Each predetermined RGB value may include a value for the red channel, green channel and blue channel of a display pixel. Thus, each RGB value may be expressed as a set of three numbers controlling the intensity of the red, green and blue components. For example, the three numbers may range from zero to 255. A zero value means no color is emitted by the corresponding channel while a 255 value means the channel emits light at full intensity. Thus, a RGB value of (255, 0, 0) may correspond to the red channel operating at full power while the green and blue channels are off. Likewise, a RGB value of (255, 255, 0) may instruct a pixel to create yellow color by combining full-intensity red and green light from the respective component but leaving the blue component entirely off. It should be appreciated that these are examples of 24-bit color; each color channel has eight bits dedicated to it. Alternative embodiments may employ greater or fewer bits per color channel.

Returning to the discussion of FIGS. 4A and 4B, the exemplary operating temperatures for constructing a color model may be selected at intervals sufficiently close together such that the color may be adjusted at small enough temperature intervals that there may be no perceptible shift in color. A color model including a luminance measurement Y and a chrominance measurement (x,y) for each of the predetermined RGB values may be constructed for each of the set of operating temperatures. For example, at an operating temperature T, a color model generated or used by the present embodiment may include a luminance measurement Y and a chrominance measurement (x,y) for each predetermined RGB value. For example, a color model may contain the following information in the following format:

| | | | | | |
|---|---|---|---|---|---|
| T1 | R1 | G1 | B1 | Y1 | (x, y)1 |
| T1 | R2 | G2 | B2 | Y2 | (x, y)2 |
| | | \| | | | |
| T1 | Rn | Gn | Bn | Yn | (x, y)n |

where the measurements (Yxy)1 through (Yxy)n correspond to the temperature T1. Accordingly, multiple luminance and chrominance values (Y and (x,y), respectively) may be measured for a variety of predetermined RGB values R1,G1,B1 to Rn,Gn,Bn at a single operating temperature T1. Also, n is the number of luminance and chrominance measurements taken at each operating temperature. For every selected operating temperature T1 through Tm, color gamuts CG1 through CGm may be constructed for each corresponding temperature. The construction of the color gamuts may be based on the color model that employ the measurements at each temperature T1 through Tm. The measurements taken at each of the temperatures T1 through Tm may be selected to cover the range from approximately the cold start-up temperature of the display to the stable operating temperature of the display. In one example, the last or stable operating temperature may be the display temperature after the display has been on for approximately two and a half hours. Generally, the color table for the last temperature may be represented as:

| | | | | | |
|---|---|---|---|---|---|
| Tm | R1 | G1 | B1 | Y1 | (x, y)1 |
| Tm | R2 | G2 | B2 | Y2 | (x, y)2 |
| | | \| | | | |
| Tm | Rn | Gn | Bn | Yn | (x, y)n |

Thus, m color gamuts CG1 through CGm may be constructed using the temperatures, predetermined RGB values, luminance measurements and chrominance measurements and the color model at each temperature T1 through Tm. The m color models may be represented as:

| | | | | | |
|---|---|---|---|---|---|
| Color model 1: | | | | | |
| T1 | R1 | G1 | B1 | Y1 | (x, y)1 |
| T1 | R2 | G2 | B2 | Y2 | (x, y)2 |
| | | \| | | | |
| T1 | Rn | Gn | Bn | Yn | (x, y)n |
| \| | | | | | |
| Color model m, | | | | | |
| Tm | R1 | G1 | B1 | Y1 | (x, y)1 |
| Tm | R2 | G2 | B2 | Y2 | (x, y)2 |
| | | \| | | | |
| Tm | Rn | Gn | Bn | Yn | (x, y)n |

In another embodiment, a color model may be constructed using a matrix model. The matrix model may employ the measurements of the following colors: the display red, green, blue and white colors, and a set of intermediates gray colors between black and white for tone reproduction curve estimation. For this embodiment, 6 intermediate gray colors may be used. The luminance measurements Y and the chrominance measurements (x,y) may be taken for a predetermined set of RGB values specified by the following n=4+6 combinations, and the (Yxy)j,k may represent the measurements for the color model k at temperature Tk, k=1 through m and for the combination j, where j may be a natural number from 1 through n=10.

| Color model 1: | | | | | |
|---|---|---|---|---|---|
| T1 | 255 | 0 | 0 | Y1, 1 | (x, y)1, 1 |
| T1 | 0 | 255 | 0 | Y2, 1 | (x, y)2, 1 |
| T1 | 0 | 0 | 255 | Y3, 1 | (x, y)3, 1 |
| T1 | 255 | 255 | 255 | Y4, 1 | (x, y)4, 1 |
| T1 | 204 | 204 | 204 | Y5, 1 | (x, y)5, 1 |
| T1 | 153 | 153 | 153 | Y6, 1 | (x, y)6, 1 |
| | | | . . . | | |
| T1 | 0 | 0 | 0 | Y10, 1 | (x, y)10, 1 |
| | | | . . . | | |
| Color model m: | | | | | |
| Tm | 255 | 0 | 0 | Y1, m | (x, y)1, m |
| Tm | 0 | 255 | 0 | Y2, m | (x, y)2, m |
| Tm | 0 | 0 | 255 | Y3, m | (x, y)3, m |
| Tm | 255 | 255 | 255 | Y4, m | (x, y)4, m |
| Tm | 204 | 204 | 204 | Y5, m | (x, y)5, m |
| Tm | 153 | 153 | 153 | Y6, m | (x, y)6, m |
| | | | . . . | | |
| Tm | 0 | 0 | 0 | Y10, m | (x, y)10, m |

The tone reproduction curve in the matrix model may be determined at each temperature T1 through Tm from the measurements Y5,k through Y10,k using an interpolation method familiar to one of ordinary skill in the art. In this embodiment, linear interpolation was employed. In another embodiment, a color model may be constructed using a matrix model where the tone reproduction curves may be independent of the temperature and estimated before the color measurements are taken at the temperature T1 through Tm. The measurement of the intermediate gray colors may be done at the initial cold or warmed up stable display temperature. The curves may be derived through interpolation one time and may be used for each color model at temperature T1 through Tm. For this embodiment, the matrix model may employ the measurements of the following colors: the device red, green, blue and white colors. The luminance measurements Y and the chrominance measurements (x,y) may be taken for a predetermined set of RGB values specified by the following n=4 combinations. Additionally, the (Yxy)j,k values may represent the measurement for the color model k at temperature Tk, k=1 through m and for the combination j, where j may be a natural number from 1 through n=10.

| Color model 1: | | | | | |
|---|---|---|---|---|---|
| T1 | 255 | 0 | 0 | Y1, 1 | (x, y)1, 1 |
| T1 | 0 | 255 | 0 | Y2, 1 | (x, y)2, 1 |
| T1 | 0 | 0 | 255 | Y3, 1 | (x, y)3, 1 |
| T1 | 255 | 255 | 255 | Y4, 1 | (x, y)4, 1 |
| | | | . . . | | |
| Color model m: | | | | | |
| Tm | 255 | 0 | 0 | Y1, m | (x, y)1, m |
| Tm | 0 | 255 | 0 | Y2, m | (x, y)2, m |
| Tm | 0 | 0 | 255 | Y3, m | (x, y)3, m |
| Tm | 255 | 255 | 255 | Y4, m | (x, y)4, m |

In another embodiment, a color model may be constructed using a look-up table model. The luminance measurements Y and the chrominance measurements (x,y) may be taken for a predetermined set of RGB values specified by the following n=6×6×6 combinations. Six intermediate values may be set for each R,G,B component, and the (Yxy)j,k may represent the measurement for the color model k at temperature Tk, k=1 through m and for the combination j, where j may be a natural number from 1 through n=216.

| Color model 1: | | | | | |
|---|---|---|---|---|---|
| T1 | 255 | 255 | 255 | Y1, 1 | (x, y)1, 1 |
| T1 | 255 | 255 | 204 | Y2, 1 | (x, y)2, 1 |
| T1 | 255 | 255 | 153 | Y3, 1 | (x, y)3, 1 |
| T1 | 255 | 255 | 102 | Y4, 1 | (x, y)4, 1 |
| | | | . . . | | |
| T1 | 0 | 0 | 0 | Y216, 1 | (x, y)216, 1 |
| | | | . . . | | |
| Color model m: | | | | | |
| Tm | 255 | 255 | 255 | Y1, m | (x, y)1, m |
| Tm | 255 | 255 | 204 | Y2, m | (x, y)2, m |
| Tm | 255 | 255 | 153 | Y3, m | (x, y)3, m |
| Tm | 255 | 255 | 102 | Y4, m | (x, y)4, m |
| | | | . . . | | |
| Tm | 0 | 0 | 0 | Y216, m | (x, y)216, m |

Moreover, the color models may be a function of multiple input parameters, as opposed to a function of temperature alone. The RGB values, luminance values and chrominance values may be recorded for multiple input parameters. For example RGB values may be recorded for combinations of input parameters such as brightness and temperature. Further, the RGB values, luminance values and chrominance values may be recorded at multiple temperatures at a first brightness level, a second brightness level and so on. Similar to previously discussed methods, the RGB values may be used to determine adjustment values such as attenuation factors. Additionally, interpolation may be used to determine adjustment values for any combination of input parameters and by employing the previously recorded RGB values, luminance values, chrominance values for the various combinations of input parameters.

Insofar as the aforementioned RGB table includes a finite number of entries, during operation of the embodiment the display's operating temperature may fall between temperatures for which entries exist in the table. Certain embodiments may use the existing entries of the RGB table to interpolate adjustment values for such interim temperatures. The adjustment constants corresponding to the interim temperature may be interpolated based on the adjustment constants of the entries in the table bounding the interim temperature (e.g., the adjustment constants for the nearest temperature above the current operating temperature and the nearest temperature below the current operating temperature). Certain embodiments use linear interpolation to calculate the interim temperature's adjustment constant, while others may use a different form of interpolation. Any known form of interpolation may be employed by various embodiments. Accordingly, RGB values may be determined for display temperatures that are not included in the existing RGB table. Moreover, it may be possible to increase the granularity of the temperatures and corresponding RGB values by interpolating between the existing RGB values and determining additional RGB values for temperatures not originally included in the RGB table. In another embodiment, previous adjustment constants may be used to determine a trend and/or a slope of change in adjustment constants to more accurately interpolate the next value.

Although the RGB values, luminance measurements and chrominance measurements have been discussed herein as a function of temperature, alternative embodiments may adjust the color output of a display based on other parameters. For example, the RGB values, luminance and chrominance may be sampled as a function of other parameters including, but not limited to, time, brightness settings, the age of the display or any combination thereof. Accordingly, the RGB table and adjustment constants generated or employed by an embodiment would account for such parameters.

Figure 5:
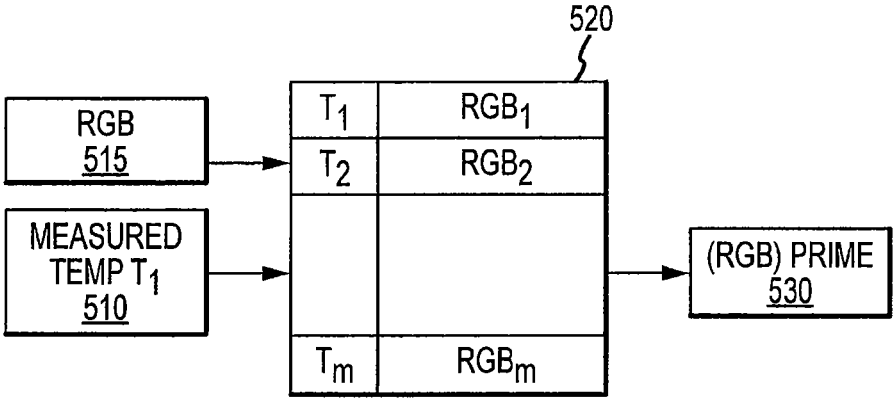
FIG. 5 depicts an exemplary look-up table, as used by an embodiment, to correct a color profile of a display in order to compensate for a temperature of an electronic display.

FIG. 5 depicts one embodiment of the general data flow for adjusting the displayed color. In FIG. 5, a measured temperature T1 510 may be a display temperature and the RGB value 515 may be used to display a particular color. The RGB value 515 may be taken at a particular temperature, thus, in this embodiment, corresponding to the temperature T1. The temperature T1 510 may be used to determine the corresponding adjustment value (RGB)AV in the RGB table 520. In one embodiment, the measured temperature T1 510 may not be in the RGB table 520 and so the closest temperature in the RGB table may be selected. The closest temperature may then be used to determine a corresponding adjustment value in the RGB table 520. Alternatively, a new adjustment value for the temperature T1 may be computed by interpolating the data provided in the RGB table 520. The adjustment value (RGB) AV (or the new adjustment value) may be applied to the RGB value 515 to yield (RGB)prime 530, which may be used to display a color The (RGB)prime may be determined as follows:

$$(RGB\ \text{value})\times(\text{adjustment value}\ (RGB)AV)=(RGB)\ \text{prime}$$

Figure 6:
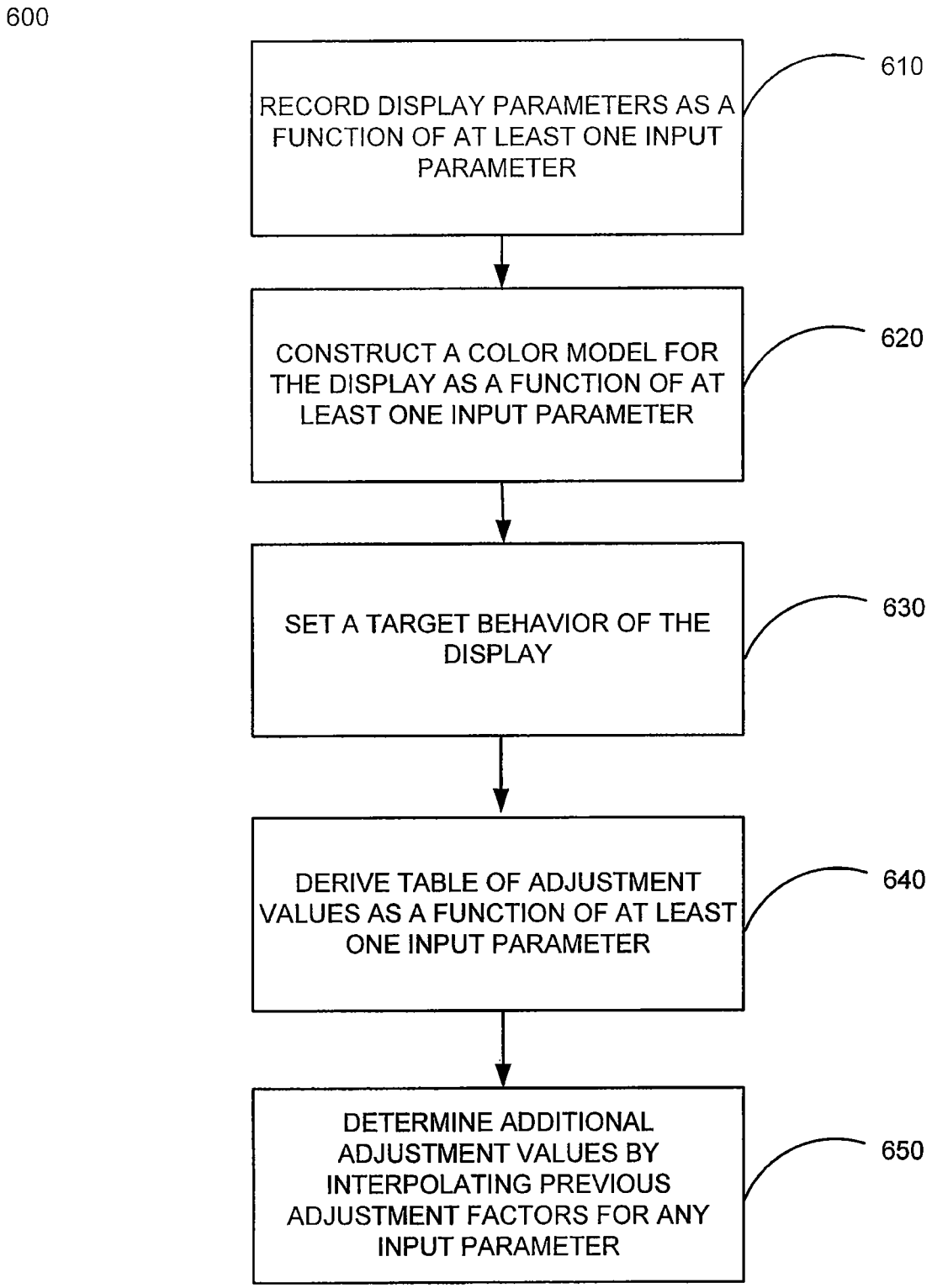
FIG. 6 is a flowchart depicting a sample method for adjusting the color of a display to account for its operating temperature.

FIG. 6 is a flowchart generally describing one embodiment of a method 600 for adjusting the displayed color. In the operation of block 610, display parameters such as luminance values and white point values may be recorded as a function of at least one parameter or a combination of parameters. The parameters may be temperature, time, brightness, ambient light, the aging of the display or any combination thereof. Additionally, other data values may be recorded (and thus adjusted) such as contrast, tone reproduction curves or any other visual parameter of the display. The luminance and white point values may be recorded over a time period such as the warming up time of a display which may be approximately two and a half hours. The intervals that the luminance and white point values may be recorded may vary. Generally, the intervals may be selected so that when the color of the display is adjusted, it may not be perceptible to a user.

In the operation of block 620, a color model may be constructed. The color model may be constructed as a matrix model or a table based model. As previously discussed, the matrix model and the table based model may yield the same color model corresponding to a specific temperature. In the operation of block 630, a target may be set that corresponds to a specific white point and luminance value. In another embodiment, the target does not have to be a fixed value corresponding to a color. The target may also be a function, and thus be a set of numbers. In the operation of block 640, the adjustment values may be computed and organized into an RGB table of adjustment values corresponding to temperatures. As previously discussed, the adjustment values may be attenuation factors for the RGB channels. In the operation of block 650, additional adjustment values may be determined by interpolating from the temperatures and adjustment values in the RGB table. By employing interpolation to determine these additional adjustment values, it may be possible to determine adjustment values for any temperature. The additional adjustment values may be stored in the RGB table.

Figure 7:
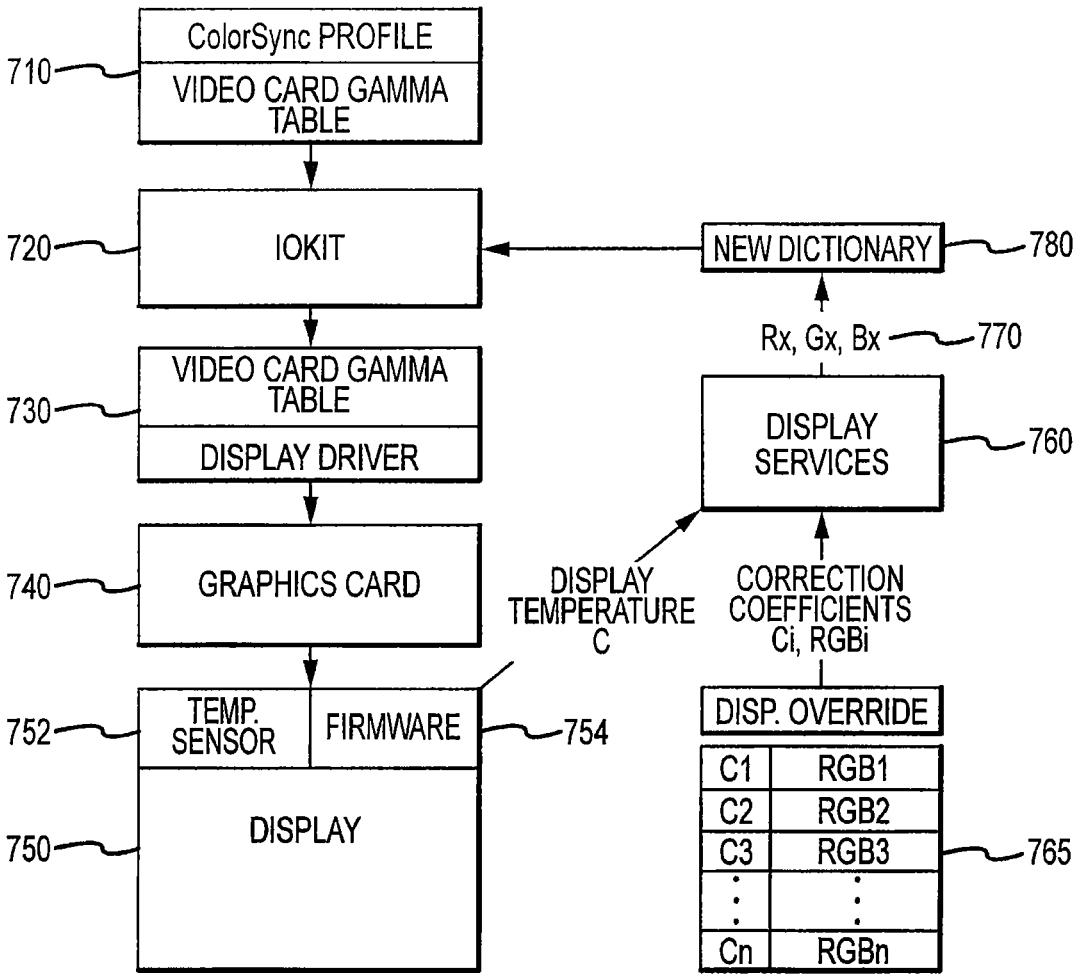
FIG. 7 depicts an embodiment of the present invention as a set of software modules operative to compensate a color profile of a display to account for a temperature of the electronic display.

FIG. 7 is an example of a system in which the displayed color may be adjusted by employing software and a table of adjustment values. In FIG. 7, the architecture represents the data flow of typically used in a Mac OS X system. The video card color data from a colorsync profile 710 may be provided to an IOkit module 720. The colorsync profile 710 may include a video card gamma table. The R G and B video card gamma tables may set a color correction of the display. Each of the RGB video card color correction tables may be attenuated for each gray level in the table with the adjustment factors calculated as previously discussed. The resulting video card tables may be loaded into the graphics card drivers and applied to the RGB data flow from the video card to the display. The IOkit module 720 may provide the data to a display driver 730 and then to a graphics card 740. Generally, the display driver 730 may allow a hardware peripheral, in this case, the display to communicate with a processor (not shown). Additionally, the graphics card 740 may generate and output data to the display 750. The display 750 may have a temperature sensor 752. The temperature sensor 752 may provide temperature measurements of the display 750. The display 750 may also have firmware 754. The firmware 754 may provide the temperature measurements provided by the temperature sensor 752 to display services 760. Display services 760 may also receive the adjustment values from the RGB table 765. The adjustment value may depend on the temperature measurements of the display 750. Display services 760 may output a set of RGB values 770 that may include adjustments for the gamma table and also for the adjustment values from the RGB table 765. The RGB values 770 may be provided to a dictionary 780. The dictionary 780 may provide RGB values 770 to the IOKit module so that the displayed image may be adjusted for the temperature.

Although the present invention has been described with respect to particular apparatuses, configurations, components, systems and methods of operation, it will be appreciated by those of ordinary skill in the art upon reading this disclosure that certain changes or modifications to the embodiments and/or their operations, as described herein, may be made without departing from the spirit or scope of the invention. Accordingly, the proper scope of the invention is defined by the appended claims. The various embodiments, operations, components and configurations disclosed herein are generally exemplary rather than limiting in scope.

The invention claimed is:

1. A method for correcting display characteristics comprising:

receiving a set of temperature values corresponding to an operating temperature of a display device;

receiving a set of predetermined red, green, and blue (RGB) color values, each predetermined RGB color value having an associated temperature value;

measuring a first display parameter and a second display parameter at each of the set of temperature values for each of the associated predetermined RGB color values to determine a set of first display parameter measurements and a set of second display parameter measurements, wherein the first display parameter comprises luminance and the second display parameter comprises chrominance;

constructing a color gamut comprising the set of first display parameter measurements, the set of second display parameter measurements, the set of predetermined RGB color values, and the set of temperature values;

computing a first set of RGB adjustment values based on the color gamut; and constructing a RGB table including the first set of RGB adjustment values and the set of temperature values.

2. The method of claim 1 further comprising:

computing a new adjustment value based, at least in part, on the first set of RGB adjustment values.

3. The method of claim 2 wherein the act of computing the new adjustment value comprises interpolating the new adjustment value from adjustment values in the first set of RGB adjustment values.

4. The method of claim 3 further comprising storing the new adjustment value and a corresponding temperature value in the RGB table.

5. A system, comprising:

a display device comprising a temperature sensor;

a memory; and a processor operatively coupled to the memory and the display device and adapted to execute program code stored in the memory to cause the processor to:

measure a parameter of an output generated by the display device at a plurality of sets of red, green, and blue (RGB) color display values for each of a plurality of temperature values to generate a color model;

receive a first temperature value from the temperature sensor;

receive a first set of RGB color display values to cause the display device to display a target color at a stable temperature value that differs from the first temperature value;

identify a set of RGB adjustment values corresponding to each RGB value in the first set computed from the color model by locating in a first table the adjustment value corresponding to the first temperature value for each color display value, wherein the color model includes measured luminance measurements and measured chrominance measurements for each RGB value in the set at the received first temperature value;

calculate a final set of RGB color display values based, at least in part, on the set of adjustment values and the first set of RGB color display values; and send the final set of RGB color display values to the display device, instead of the first set of RGB color display values, to display the target color.

6. The system of claim 5, wherein the program code to cause the processor to identify the set of RGB adjustment values comprises program code to cause the processor to select the adjustment values from a table based, at least in part, on the first temperature value.

* * * * *